US006807813B1

(12) United States Patent
Lesage

(10) Patent No.: US 6,807,813 B1
(45) Date of Patent: Oct. 26, 2004

(54) REFRIGERATION DEFROST SYSTEM

(76) Inventor: Gaetan Lesage, 817 Salaberry, Laval, QBC (CA), H7S 1H5

( * ) Notice: Subject to any disclaimer, the term of this patent is extended or adjusted under 35 U.S.C. 154(b) by 0 days.

(21) Appl. No.: 10/420,723

(22) Filed: Apr. 23, 2003

(51) Int. Cl.[7] ..... F25B 41/00; F25B 47/00
(52) U.S. Cl. ..... 62/81; 62/278
(58) Field of Search ..... 62/81, 278, 324.5, 62/151, 277, 506, 507, 509, 197, 113, 513

(56) References Cited

U.S. PATENT DOCUMENTS

| | | | | |
|---|---|---|---|---|
| 4,009,594 A | | 3/1977 | Swanson | |
| 4,102,151 A | | 7/1978 | Kramer et al. | |
| 4,158,950 A | * | 6/1979 | McCarty | 62/278 |
| 4,279,129 A | | 7/1981 | Cann et al. | |
| 4,318,277 A | | 3/1982 | Cann et al. | |
| 4,602,485 A | | 7/1986 | Fujimoto et al. | |
| 4,688,392 A | | 8/1987 | Fujimoto et al. | |
| 4,914,926 A | | 4/1990 | Gregory | |
| 4,949,551 A | | 8/1990 | Gregory | |
| 5,050,400 A | | 9/1991 | Lammert | |
| 5,056,327 A | | 10/1991 | Lammert | |
| 5,065,584 A | | 11/1991 | Byczynski et al. | |
| 5,315,836 A | | 5/1994 | Ressler | |
| 5,551,250 A | | 9/1996 | Yingst et al. | |
| 5,575,158 A | | 11/1996 | Vogel | |
| 5,867,993 A | | 2/1999 | Dube | |
| 5,887,440 A | | 3/1999 | Dube | |
| 6,286,322 B1 | | 9/2001 | Vogel et al. | |

FOREIGN PATENT DOCUMENTS

JP 54104058 A * 8/1979 ..... F25B/5/00

* cited by examiner

*Primary Examiner*—Chen Wen Jiang

(57) ABSTRACT

A refrigeration defrost system includes a frosted evaporator with an evaporator refrigerant vapor line and an evaporator refrigerant liquid line. A compressor with a suction inlet and a discharge outlet are both connected to a discharge manifold. The discharge outlet is connected to the evaporator refrigerant vapor line. A pressure regulator valve is located in a refrigerant bypass passageway between the discharge manifold and the suction inlet line and feeds refrigerant vapor, when a defrost cycle is required, from the discharge manifold into the suction inlet. A check valve is connected in series with the regulator valve to stop low pressure refrigerant vapor from the evaporator refrigerant vapor line from feeding into the suction inlet. The refrigerant vapor is fed from the compressor into the discharge outlet and into the evaporator through the evaporator refrigerant vapor line, which defrosts the evaporator.

13 Claims, 4 Drawing Sheets

REFRIGERATION DEFROST SYSTEM

FIELD OF THE INVENTION

The present invention concerns refrigeration systems, more particularly refrigeration defrost systems for defrosting a frosted evaporator.

BACKGROUND OF THE INVENTION

Refrigeration systems are well known and widely used in supermarkets and warehouses to refrigerate, or maintain in a frozen state, perishable items, such as foodstuff.

Conventionally, refrigeration systems include a network of refrigeration compressors and evaporators. Refrigeration compressors mechanically compress refrigerant vapors, which are fed from the evaporators, to increase their temperature and pressure. High temperature refrigerant vapors, under high-pressure, are fed to an outdoor air-cooled refrigerant condenser whereupon air, at ambient temperature, absorbs the latent heat from the vapors, as a result the refrigerant vapors liquefy. The liquefied refrigerant is fed through expansion valves, to reduce the temperature and pressure, to the evaporators whereupon the liquefied refrigerant evaporates by absorbing heat from the surrounding foodstuff.

Since most evaporators operate at evaporating refrigerant temperatures that are lower than the freezing point of water (32° F., 0° C.), water vapor from ambient air freezes on the heat transfer surface of the evaporators, which creates a layer of frost on the surface. The frost layer decreases the efficiency of the heat transfer between the evaporator and the ambient air, which causes the temperature of the refrigerated space to increase above the required level. Maintaining the correct temperature of the refrigerated space is vitally important to maintain the quality of the stored food products. To do this, the evaporators must be defrosted regularly in order to reestablish their efficiency. During the defrosting period, the evaporator is out of service. It is therefore important to reduce the duration of the defrost period to avoid excessive rise of the refrigerated space temperature.

Several patents exist that have tried to solve the problem of defrosting a frosted evaporator, including:

- U.S. Pat. No. 4,102,151, issued on Jul. 25, 1978, to Kramer et al, for "Hot Gas Defrost System with Dual Function Liquid Line".
- U.S. Pat. No. 5,575,158, issued on Nov. 19, 1996, to Vogel for "Refrigeration Defrost Cycles".
- U.S. Pat. No. 5,056,327, issued on Oct. 15, 1991, to Lammert for "Hot gas Defrost Refrigeration System".
- U.S. Pat. No. 5,050,400, issued on Sep. 24, 1991 to Lammert for "Simplified Hot Gas Defrost Refrigeration System".
- U.S. Pat. No. 6,286,322, issued on Sep. 11, 2001 to Vogel for "Hot gas Refrigeration System".

The above systems suffer from a number of significant drawbacks such as the use of complex systems of pipes, valves, water tanks, all of which may be difficult to maintain. Disadvantageously, some of the above systems require the addition of a superheater to appropriately route the refrigerant during the defrost cycle, thereby adding to the complexity and cost of the system.

A common method for defrosting a frosted evaporator is the so-called hot refrigerant gas defrost method. Hot, high pressure refrigerant gas from a common discharge manifold or from an upper part of a refrigerant receiver, is fed backwards to the evaporator to be defrosted. The hot refrigerant gas is liquefied during its passage through the evaporator and its latent heat is used to melt the frost on the evaporator surface. The duration of the defrost period is directly proportional to the refrigerant mass flow. The higher the mass flow, the shorter the defrost period will be.

Disadvantageously, the refrigerant mass flow during a defrost cycle depends solely on the condensing pressure of the refrigeration system which, especially during the colder periods of the year, when the possibility to operate with lower condensing pressures and therefore more efficiently is readily available, is economically unacceptable.

Also, the liquid refrigerant obtained during the defrost is returned to the liquid line of the refrigeration system thus having a disruptive effect on the quality of the liquid refrigerant fed to the evaporators in normal operation, for example, so called "flash gas", higher liquid temperature, and insufficient feeding of the most distant evaporators.

Thus there is a need for a refrigeration system that is simple and inexpensive to operate, and which can be used simultaneously with the normal refrigeration cycle.

SUMMARY OF THE INVENTION

The inventor has made a surprising and unexpected discovery that a single, dedicated compressor can be used to defrost a frosted evaporator in a refrigeration system. Moreover, during a defrost cycle, the single compressor operates with considerably higher suction pressure that the rest of the refrigeration compressor thus increasing efficiency and improving power consumption. Advantageously, the liquefied refrigerant is returned to the inlet of the refrigerant air cooled condenser, thus providing efficient cooling of the high pressure hot refrigerant gas before its entry into the refrigerant condenser, which increases the condenser efficiency during high ambient temperature periods of the year and reducing the condensing pressure. Another advantage is that during the cooler periods of the year, the refrigeration defrost system operates with low condensing pressures and provides efficient and rapid defrost cycle.

Also, the compressor avoids the fluctuations of the refrigeration system pressures. During a defrost cycle, a high-pressure refrigerant gas is fed to the suction of the dedicated defrost compressor thus increasing its suction pressure, mass flow and power consumption efficiency. Also during the defrost cycle, the liquid refrigerant is fed through a desuperheating expansion valve to the suction of the dedicated defrost compressor to maintain acceptable suction temperature.

In a first aspect of the present invention, there is provided a refrigeration defrost system including at least one frosted evaporator having an evaporator refrigerant vapor line and an evaporator refrigerant liquid line, said system comprising, a first compressor having a suction inlet line and a discharge outlet line each connected to a discharge manifold, said discharge outlet being connected to said evaporator refrigerant vapor line; a first pressure regulator valve disposed in a refrigerant bypass passageway between said discharge manifold and said suction inlet line, for feeding refrigerant vapor, when a defrost cycle is required, from said discharge manifold into said suction inlet line, and a first check valve in series connection with said first pressure regulator valve for stopping low pressure refrigerant vapor from said evaporator refrigerant vapor line from feeding into said suction inlet line, said refrigerant vapor being fed from said first compressor into said discharge outlet line and into said frosted evaporator through said evaporator refrigerant vapor line thereby defrosting said frosted evaporator.

In another aspect, a refrigeration defrost system, as described above, further includes a condenser having a condenser refrigerant vapor line and a condenser liquid refrigerant line, said condenser liquid refrigeration line being connected to said evaporator liquid refrigeration line, said first pressure regulator valve, during a refrigeration cycle, stops said refrigerant vapor from entering said suction inlet line, said condenser feeding liquid refrigerant into said evaporator liquid refrigerant line and said evaporator refrigerant vapor line feeding refrigerant vapor into said suction inlet line.

In another aspect, a refrigeration defrost system as described above further includes a motorized ball valve disposed in a refrigerant defrost manifold between said discharge outlet line and said evaporator, in series connection with said first pressure regulator valve, for gradually feeding said refrigerant vapor into said evaporator refrigerant vapor line.

Typically, in a refrigeration defrost system, as described above, a T-junction connects said refrigerant bypass passageway with said discharge manifold. The refrigerant bypass passageway further includes a solenoid valve and an expansion valve, in series connection between said suction inlet line and said condenser liquid refrigerant line, for feeding liquid refrigerant from said condenser liquid refrigerant line into said suction inlet line. The expansion valve is a desuperheating expansion valve.

Typically, in a refrigeration defrost system, as described above, in which said condenser further includes a liquid refrigerant return inlet line connected to said evaporator refrigerant liquid line for feeding liquefied refrigerant into said condenser during said defrost cycle. A second check valve is connected between said evaporator refrigerant liquid line and said liquid refrigerant return inlet line.

In another aspect, a refrigeration defrost system, as described above, further includes a second pressure regulator valve disposed in said discharge outlet line, said second pressure regulator valve regulating discharge outlet pressure during said defrost cycle.

Typically, a refrigeration defrost system, as described above, further includes a liquid refrigerant receiver connected between said condenser and said evaporator.

According to a second aspect of the present invention, the refrigeration defrost system further includes: first and second heat exchangers, said first heat exchanger being connected to said discharge manifold, said second heat exchanger being connected to said evaporator; a hot water tank connected to said first and second heat exchangers; and a three-way valve connected between said hot water tank and said first heat exchanger.

Typically, a three-way motorized valve is connected between said first heat exchanger and said discharge manifold, said three-way valve being closed during said defrost cycle, hot water from said hot water tank flowing into said second heat exchanger and into said frosted evaporator to defrost said frosted evaporator.

According to a third aspect of the present invention, there is provided A method of defrosting a frosted evaporator, said method comprising: feeding refrigerant vapor from a discharge manifold into a first compressor suction inlet line; feeding said refrigerant vapor from said discharge outlet line into an evaporator suction inlet line; stopping low pressure refrigerant vapor from entering said compressor suction inlet line via a first check valve, thereby defrosting said frosted evaporator.

BRIEF DESCRIPTION OF THE FIGURES

Further aspects and advantages of the present invention will become better understood with reference to the description in association with the following Figures, wherein.

DETAILED DESCRIPTION OF THE PREFERRED EMBODIMENTS

Figure 1:
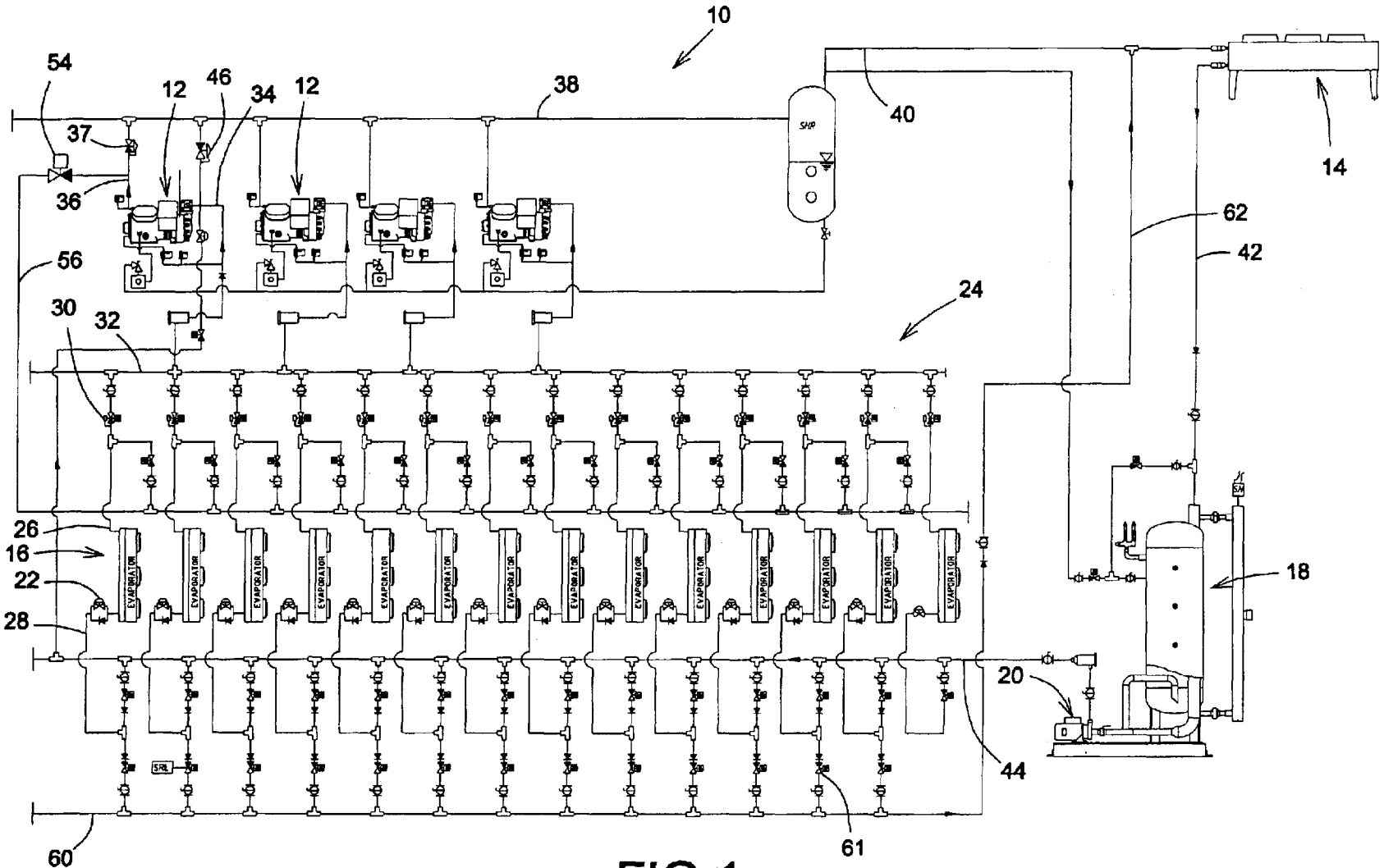
FIG. 1 is a schematic diagram of an embodiment of a refrigeration defrost system having multiple evaporators and multiple compressors.
Figure 2:
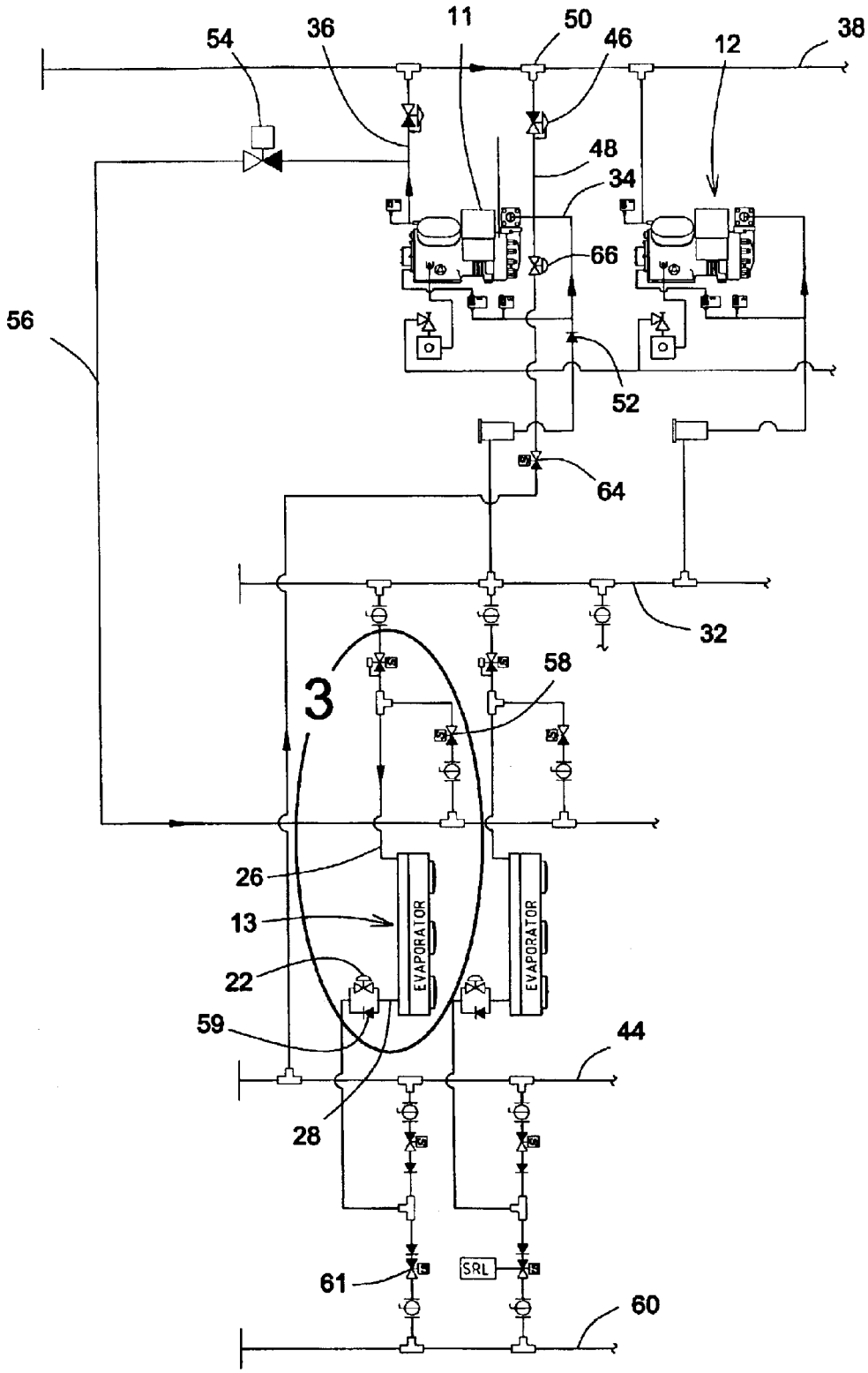
FIG. 2 is a schematic diagram of the refrigeration defrost system of FIG. 1 showing a dedicated defrost compressor.

With reference now to FIGS. 1 and 2, a refrigeration defrost system according to a first embodiment of the invention is generally illustrated at 10. Broadly speaking, the defrost system 10 includes one or more compressors 12, a refrigeration condenser 14, one or more evaporators 16, a liquid refrigerant receiver 18, a liquid refrigerant pump 20, one or more expansion valves 22, and a network, shown generally at 24 that includes a variety of passageways (or conduits), valves and manifolds, through which the liquid refrigerant pump 20, the evaporators 16, the compressors 12, and the condenser 14 are interconnected to circulate refrigeration fluid.

During a refrigeration cycle (or non-defrost cycle), the compressors 12 compress low-pressure refrigerant vapors from the evaporators 16. Each evaporator 16 includes an evaporator refrigerant vapor line 26 and an evaporator refrigerant liquid line 28. The evaporator vapor line 26 feeds the low-pressure refrigerant vapors through a pressure-regulating valve 30 into a suction manifold 32 and then into the compressors 12. The compressors 12 include a suction inlet line 34 and a discharge outlet line 36. The suction inlet line 34 receives the low pressure refrigerant vapor from the suction manifold 32 and the compressor 12 compresses the low-pressure refrigerant vapor thereby increasing its pressure and temperature and producing hot, high pressure refrigerant vapor. The condenser 14 receives the hot, high pressure refrigerant vapor from the discharge outlet line 36 through an electrically open second pressure regulator valve 37, disposed in the discharge outlet line 36, though a discharge manifold 38 and a conduit 40 which connect the compressors 12 to the condenser 14. The conduit 40 acts as a condenser refrigerant vapor line. In this embodiment, the condenser 14 is an outdoor air-cooled refrigeration condenser that is normally mounted on a roof of a building, although those skilled in the art will recognize that other types of condenser may be used to implement aspects of the invention. The condenser 14 condenses the hot, high pressure refrigerant vapors to produce high pressure liquid refrigerant that feeds through a condensate return conduit 42, which acts as a condenser refrigerant liquid line, to the liquid refrigerant receiver 18. A liquid refrigerant manifold 44 connects the liquid refrigerant pump 20 with the evaporators 16 through each expansion valve 22 and feeds the liquid refrigerant into evaporators 16 through the evaporator refrigerant liquid line 28, thereafter the refrigerant vapor feeds from the evaporator vapor line 26 into the suction manifold 32.

Figure 3:
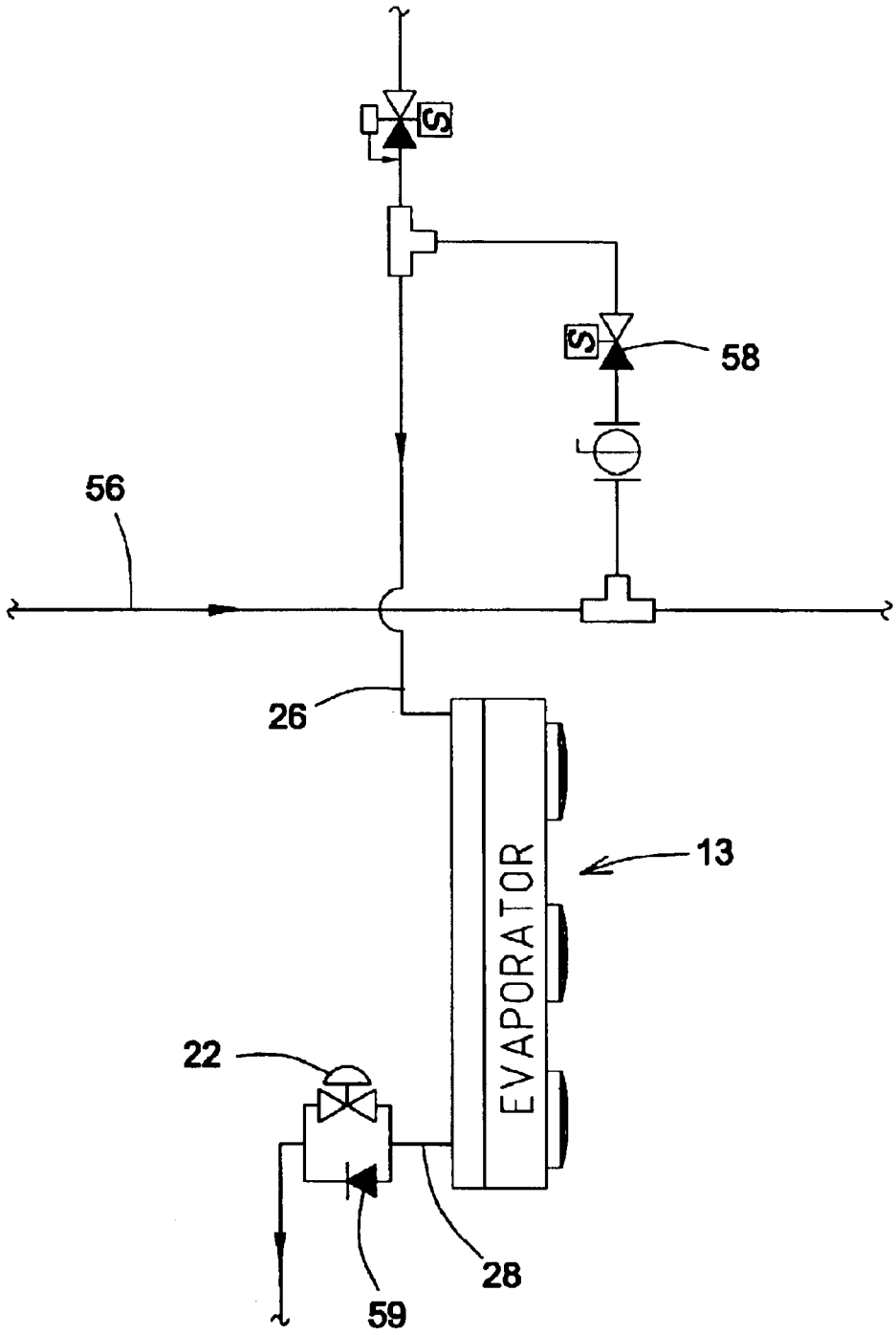
FIG. 3 is a schematic diagram of a frosted evaporator from FIG. 2 connected to a dedicated compressor for defrosting.

Referring now to FIGS. 2 and 3, when a defrosting cycle is required to defrost a frosted evaporator a signal from a refrigeration control system (not shown) isolates and dedicates a single compressor 11 to defrost a frosted evaporator 13, by energizing open a first pressure regulator valve 46, normally electrically closed during the refrigeration cycle. The valve 46 is disposed in a refrigerant bypass passageway 48 that is connected between the suction inlet line 34 and the discharge manifold 38. A T-junction 50 connects the bypass passageway 48 to the discharge manifold 38. The second pressure regulator valve 37, which is electrically open during the refrigeration cycle, now regulates the discharge outlet pressure. As best illustrated in FIG. 2, the open valve 46 feeds refrigerant vapor from the discharge manifold 38 (in the direction of the arrows) into the suction inlet line 34 along the bypass passageway 48. The refrigerant vapors then feed from the compressor 11 into the discharge outlet line 36. This increases the pressure to a level higher than the pressure in the suction manifold such that a first check valve 52, in series connection with the pressure regulator valve 46, closes to stop low pressure refrigerant vapor from the evaporator refrigerant vapor line 26 from feeding into the suction inlet line 34. The signal from the refrigeration control system causes a motorized ball valve 54 that is disposed in a refrigerant defrost manifold 56 between the discharge outlet line 36 and the evaporator refrigerant vapor line 26, to gradually open towards the manifold 56. This gradual opening of valve 54, in series connection with the valve 46 and the manifold .38, gradually feeds refrigerant vapor from the discharge outlet line 36 towards the frosted evaporator 13 through the evaporator refrigerant vapor line 26. The gradual opening of the valve 54 prevents the occurrence of thermal and mechanical stress in the evaporators during the defrost cycle. The increased suction pressure at the dedicated compressor 11 provides up to 70% higher mass flow, which ensures accelerated defrost cycles. The refrigerant defrost manifold 56 is in series connection with the pressure regulator valve 46 and the discharge outlet line 36.

As best illustrated in FIG. 3, the hot, high pressure refrigerant vapor feeds from the refrigerant defrost manifold 56 into the frosted evaporator 13 through a solenoid valve 58 and into the evaporator 13 through the evaporator vapor line 26. Normally, during the refrigeration cycle, the evaporator vapor line 26 feeds low pressure vapor into the suction inlet line 34 via the suction manifold 32. In the defrost cycle, the low pressure evaporator vapor line 26 receives the hot, high pressure refrigerant from the discharge outlet line 36. The hot, high pressure refrigerant vapor defrosts the frosted evaporator 13 and converts the high pressure vapor into liquid refrigerant which exits the evaporator 13 through a check valve 59 and the evaporator liquid refrigerant line 28.

Referring to FIGS. 1 and 2, normally during the refrigeration cycle, the evaporator liquid refrigerant line 28 receives liquid refrigerant from the liquid refrigerant receiver 18 along the liquid refrigerant manifold 44. During the defrost cycle, liquid condensate (liquid refrigerant) from the defrosted evaporator via the evaporator refrigerant liquid line 28 enters a defrost condensate return manifold 60 through a second solenoid valve 61 and into a liquid refrigerant return inlet line 62 with sufficient pressure to feed it into the condenser 14.

Referring to FIG. 2, when the refrigeration system control opens the valve 46, a solenoid valve 64 opens and feeds liquid refrigerant from the liquid refrigerant manifold 44 into the suction inlet line 34 via an expansion valve 66. The solenoid valve 64 and the expansion valve 66 are disposed in the refrigerant bypass passageway 48 and are in series connection between the suction inlet line 34 and the liquid refrigerant manifold 44. The expansion valve 66 is a so-called desuperheating expansion valve and is used to maintain the temperature at an acceptable level at the suction inlet line 34 by allowing liquid refrigerant to mix with hot, high pressure refrigerant vapor at the suction inlet line 34 of the compressor 11 during the defrost cycle.

After the frosted evaporator 13 is defrosted, the pressure regulator valve 46 closes to reestablish the compressor 11 as a non-defrost compressor 12 for normal refrigeration operation as described above.

One skilled in the art will recognize that the single dedicated compressor 11 may be used to defrost more than one frosted evaporator. This can be achieved by controlling the hot, high pressure refrigerant's pathway from the refrigerant defrost manifold 56 into multiple frosted evaporators via each frosted evaporator's vapor line.

Figure 4:
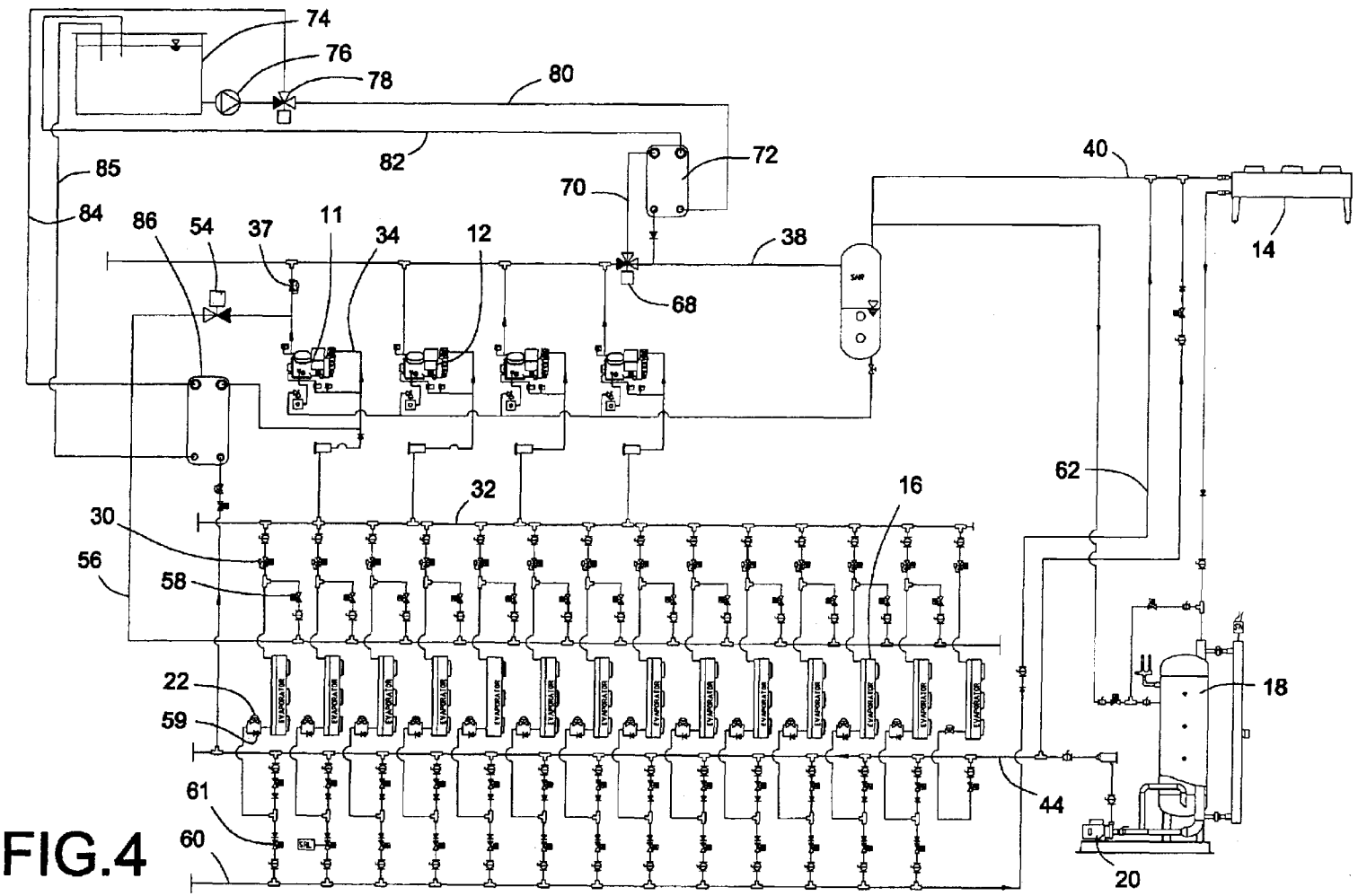
FIG. 4 is a schematic diagram of another embodiment of the refrigeration defrost system.

In another embodiment, a source of heat may be used to increase the suction pressure of the single dedicated defrost compressor 11 during the defrost cycle. As best illustrated in FIG. 4, an additional circuit is added to the existing system 10 and includes a hot water tank 74, a three-way motorized valve 68, a pump 76 and two heat exchangers 72, 86, all interconnected by a number of conduits 70, 80, 82, 84, and 85. During the normal refrigeration cycle, the hot, high pressure refrigerant vapors flow from the compressors 11 and 12 though the three way valve 68 along the conduit 70 to the first heat exchanger 72. The pump 76 feeds water from the water tank 74 through a motorized valve 78 and along the conduit 80 to the heat exchanger 72. The hot water from the first heat exchanger 72 is fed through the conduit 82 back to water tank 74. The refrigerant leaving the heat exchanger 72 is fed through the conduits 38 and 40 to the external air-cooled condenser 14. When the water temperature in the water tank 74 reaches a predetermined value, the three-way valve 68 closes the conduit 70 and opens the conduit 38, which allows the hot, high pressure refrigerant vapors to flow to the air-cooled condenser 14, thereby by-passing the first heat exchanger 72.

When a defrost is required, the refrigeration control system signals the motorized valve 78 to close the conduit 80 and open the conduit 84, which allows the hot water to flow through the second heat exchanger 86. At this point, the pressure-regulating valve 37 will be de-energized and will maintain the discharge pressure of compressor 11 at higher level than the pressure in the discharge manifold 38. The motorized valve 54 will open the conduit 56 allowing the hot high-pressure refrigerant vapors from the compressor 11 to flow towards the refrigerant circuit and the evaporator to be defrosted. In this mode, the second heat exchanger 86 operates as an evaporator for the compressor 11, such that the heat from the hot water will be absorbed by the second heat exchanger 86 and then used to defrost the frosted evaporator. The amount of water in the water tank 74 and the temperature at which the water should be maintained will depend on the amount of heat required to defrost the frosted evaporator.

I claim:

1. A refrigeration defrost system including at least one frosted evaporator having an evaporator refrigerant vapor line and an evaporator refrigerant liquid line, said system comprising:

a) a first compressor having a suction inlet line and a discharge outlet line each connected to a discharge manifold, said discharge outlet being connected to said evaporator refrigerant vapor line;

b) a first pressure regulator valve disposed in a refrigerant bypass passageway between said discharge manifold and said suction inlet line, for feeding refrigerant vapor, when a defrost cycle is required, from said discharge manifold into said suction inlet line; and c) a first check valve in series connection with said first pressure regulator valve for stopping low pressure refrigerant vapor from said evaporator refrigerant vapor line from feeding into said suction inlet line, said refrigerant vapor being fed from said first compressor into said discharge outlet line and into said frosted evaporator through said evaporator refrigerant vapor line, thereby defrosting said frosted evaporator.

2. The refrigeration defrost system, according to claim 1, further includes a condenser having a condenser refrigerant vapor line and a condenser liquid refrigerant line, said condenser liquid refrigeration line being connected to said evaporator liquid refrigeration line, said first pressure regulator valve, during a refrigeration cycle, stops said refrigerant vapor from entering said suction inlet line, said condenser feeding liquid refrigerant into said evaporator liquid refrigerant line and said evaporator refrigerant vapor line feeding refrigerant vapor into said suction inlet line.

3. The refrigeration defrost system, according to claim 2, in which said condenser further includes a liquid refrigerant return inlet line connected to said evaporator refrigerant liquid line for feeding liquefied refrigerant into said condenser during said defrost cycle.

4. The refrigeration defrost system, according to claim 3, in which a second check valve is connected between said evaporator refrigerant liquid line and said liquid refrigerant return inlet line.

5. The refrigeration defrost system, according to claim 1, further includes a motorized ball valve disposed in a refrigerant defrost manifold between said discharge outlet line and said evaporator, in series connection with said first pressure regulator valve, for gradually feeding said refrigerant vapor into said evaporator refrigerant vapor line.

6. The refrigeration defrost system, according to claim 1, in which a T-junction connects said refrigerant bypass passageway with said discharge manifold.

7. The refrigeration defrost system, according to claim 6, in which said refrigerant bypass passageway further includes a solenoid valve and an expansion valve, in series connection between said suction inlet line and said condenser liquid refrigerant line, for feeding liquid refrigerant from said condenser liquid refrigerant line into said suction inlet line.

8. The refrigeration defrost system, according to claim 7, in which said expansion valve is a desuperheating expansion valve.

9. The refrigeration defrost system, according to claim 1, further includes a second pressure regulator vale disposed in said discharge outlet line, said second pressure regulator valve regulating discharge outlet pressure during said defrost cycle.

10. The refrigeration defrost system, according to claim 1, further includes a liquid refrigerant receiver connected between said condenser and said evaporator.

11. The refrigeration defrost system according to claim 1, further includes:

a) first and second heat exchangers, said first heat exchanger being connected to said discharge manifold, said second heat exchanger being connected to said evaporator;

b) a hot water tank connected to said first and second heat exchangers; and c) a three-way valve connected between said hot water tank and said first heat exchanger.

12. The refrigeration defrost system, according to claim 11, in which a three-way motorized valve is connected between said first heat exchanger and said discharge manifold, said three-way valve being closed during said defrost cycle, hot water from said hot water tank flowing into sold second heat exchanger and into said frosted evaporator to defrost said frosted evaporator.

13. A method of defrosting a frosted evaporator, said method comprising:

a) feeding refrigerant vapor from a discharge manifold into a first compressor suction inlet line;

b) feeding said refrigerant vapor from said discharge outlet line into an evaporator suction inlet line;

c) stopping low pressure refrigerant vapor from entering said compressor suction inlet line via a first check valve, thereby defrosting said frosted evaporator.

* * * * *